US008091730B2

(12) United States Patent
Keefe et al.

(10) Patent No.: US 8,091,730 B2
(45) Date of Patent: Jan. 10, 2012

(54) READILY CLEANABLE SPILL-RESISTANT DRINKING VESSEL AND VALVE

(75) Inventors: Gwendolyn Huyen Keefe, Long Beach, CA (US); Jeffery Laurence Harlan, Corona, CA (US); John Joseph Keefe, III, Long Beach, CA (US)

(73) Assignee: Granola BeBe LLC, Long Beach, CA (US)

( * ) Notice: Subject to any disclaimer, the term of this patent is extended or adjusted under 35 U.S.C. 154(b) by 261 days.

(21) Appl. No.: 12/465,612

(22) Filed: May 13, 2009

(65) Prior Publication Data

US 2010/0147862 A1 Jun. 17, 2010

Related U.S. Application Data

(60) Provisional application No. 61/122,629, filed on Dec. 15, 2008.

(51) Int. Cl.
*A47G 19/22* (2006.01)

(52) U.S. Cl. ..... 220/714; 220/203.18

(58) Field of Classification Search ..... 220/203.18, 220/708, 714, 717; 215/11.4, 11.5, 387
See application file for complete search history.

(56) References Cited

U.S. PATENT DOCUMENTS

| | | | | |
|---|---|---|---|---|
| 4,442,948 | A | 4/1984 | Levy et al. | |
| 4,795,052 | A | 1/1989 | Hayes, Jr. | |
| 5,706,973 | A | 1/1998 | Robbins, III et al. | |
| 5,890,620 | A | 4/1999 | Belcastro | |
| 5,890,621 | A | 4/1999 | Bachman et al. | |
| 6,050,445 | A | 4/2000 | Manganiello | |
| 6,321,931 | B1 * | 11/2001 | Hakim et al. | 220/714 |
| 6,568,557 | B2 | 5/2003 | Fusco et al. | |
| 6,598,757 | B2 * | 7/2003 | Stillinger et al. | 220/712 |
| 6,607,092 | B2 | 8/2003 | Manganiello et al. | |
| 7,147,126 | B2 | 12/2006 | Samson et al. | |
| 7,210,596 | B1 | 5/2007 | Ruccolo | |

(Continued)

FOREIGN PATENT DOCUMENTS

WO 2006031116 A1 3/2006

OTHER PUBLICATIONS

Born Free, Product Flyer from manufacturer's web site—shows Born Free Trainer Cup exploded. Color—1 page Downloaded from internet www.newbornfree.com/pics/bornfree/index_trainers.htm on Oct. 8, 2009 5:40pm.

(Continued)

*Primary Examiner* — Harry Grosso
(74) *Attorney, Agent, or Firm* — George P. White

(57) ABSTRACT

A no-spill drinking vessel includes a cup, lid, spout and valve assembly. The valve assembly includes: a liquid-out valve with hinged flap, air vent check valve, air and liquid inlets, air and liquid outlets, and a mechanism for retention to the lid. The valve assembly is constructed from inexpensive molded elastomeric components. In usage mode these components cleave sealingly together by the resilient returning forces they exert on each other's complementary interlocked geometries. The fluid and air passageways, inlet and outlet port openings, mouthpiece channels and openings, and the interior volumes of the valve bodies are defined by spaces between the abutted elastomeric components. When manually separated into a cleaning configuration, the interior liquid-contacting surfaces become exposed, external surfaces for ready cleaning. The closure is baby-proof and small parts are tethered together.

25 Claims, 10 Drawing Sheets

U.S. PATENT DOCUMENTS

| | | | |
|---|---|---|---|
| 7,243,814 | B2 | 7/2007 | Hakim |
| 2006/0169694 | A1 | 8/2006 | Kemper |
| 2006/0213912 | A1 | 9/2006 | Zaytoun |
| 2008/0128438 | A1 | 6/2008 | Lane |

OTHER PUBLICATIONS

Born Free, Product insert brochure—shows Born Free Training and Drinking Cups exploded, cleaning, assembly and disassembly instructions. Color—1 page. Copyright Jul. 2008. Philips AVENT Non-Spill Toddler Spouts—shows Spouts from both top and bottom. Color—2 pages. Downloaded from internet www.mothertochild.com/avnotosp.html on Oct. 8, 2009 5:43pm.

Handi-Craft Company, Dr Brown's Training Cup, product insert brochure—shows instructions for disassembly, cleaning and reassembly and illustrations. Color—2 pages. Copyright 2008.

Born Free, Drinking Cup—shows 1 picture assembled and 5 pictures as a disassembled unit. Photography taken on Feb. 11, 2009 by applicant's representative . Color—1 page.

Philips AVENT Cup, SCF608—shows 1 picture of an assembled unit and 9 pictures in states of disassembly . Photography taken on Feb. 15, 2009 by applicant's representative. Color—1 page.

* cited by examiner

READILY CLEANABLE SPILL-RESISTANT DRINKING VESSEL AND VALVE

RELATED APPLICATIONS

This application claims priority from U.S. provisional application 61/122,629 filed Dec. 15, 2008, which is hereby incorporated herein by reference in its entirety.

FIELD

The described invention relates to spill-resistant drinking cups, spouts, and valves for such cups. Implementations intended for use by young children are known as trainer cups, sippy cups, and as no-spill cups.

BACKGROUND

Many types of reusable drinking devices designed to limit accidental spilling are known. These cups have three general goals that are in significant tension with each other. One is to allow a user to readily intentionally drink a liquid. The second is to limit the flow rate or total volume of liquid emanated in the case of a non-drinking situation. For example, on occasions when the vessel is being dropped, thrown or is otherwise not upright and stable it is desirable to minimize spillage. In a reusable device, a third goal is confident cleanability, preferably with little risk of loosing various small parts. Many spill resistant designs feature constricted passageways and small spout and air vent openings. Some designs have slit valves. These characteristics can lead to cups that are difficult to clean compared with household food preparing and serving items generally. Cleanability issues are amplified by the general problems of cleaning milk and the heightened concern for cleanliness a parent might have for their child's drinking devices.

Designs with sophisticated valves may also have the deficiencies of complexity and of small parts that can be easy to lose. Those without valve mechanisms generally are either too hard to extract liquid from while drinking or too easy to spill liquid from when shaken or tipped over. Although many diverse designs are known there is nevertheless a need for a solution that allows drinking without undue effort yet limits spillage under real-world use conditions. It should also be as readily cleanable as most other food serving items.

SUMMARY

Disclosed devices and technology solve the no-spill cup functionality and cleanability problems by having a valve and a mouthpiece in which a fluid channel is created and defined by the spaces and interfaces between immediately adjacent, opposed surfaces. In many versions one or more of the surfaces are composed of a resilient material. For cleaning, the adjacent surfaces are separated, turning formerly internal liquid contacting areas into readily cleanable external areas. In some implementations the adjacent surfaces are embodied in one or more molded elastomeric parts. The elastomeric parts of some particular versions having concave features may be abutted and cleave to each other in a watertight manner primarily due to the resilient forces acting on interlocking portions of their surfaces. Some versions include the loose tethering of small parts to further improve cleanability. Others include a baby-proof lid lock with an indicum of entering a locked state to reduce likelihood of spilling.

DESCRIPTION OF THE DRAWINGS

Features, aspects, and advantages of the spill-resistant valve, spout, cap, and complete cup will be better understood with reference to the following drawings.

DETAILED DESCRIPTION

Figure 1A:
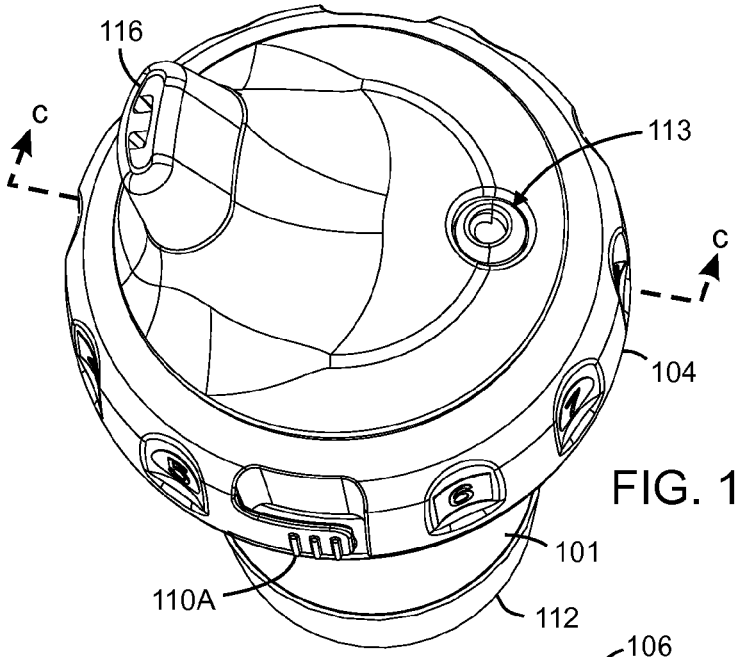
FIG. 1A is a perspective view of a specific embodiment of a non-spill drinking apparatus.
Figure 1B:
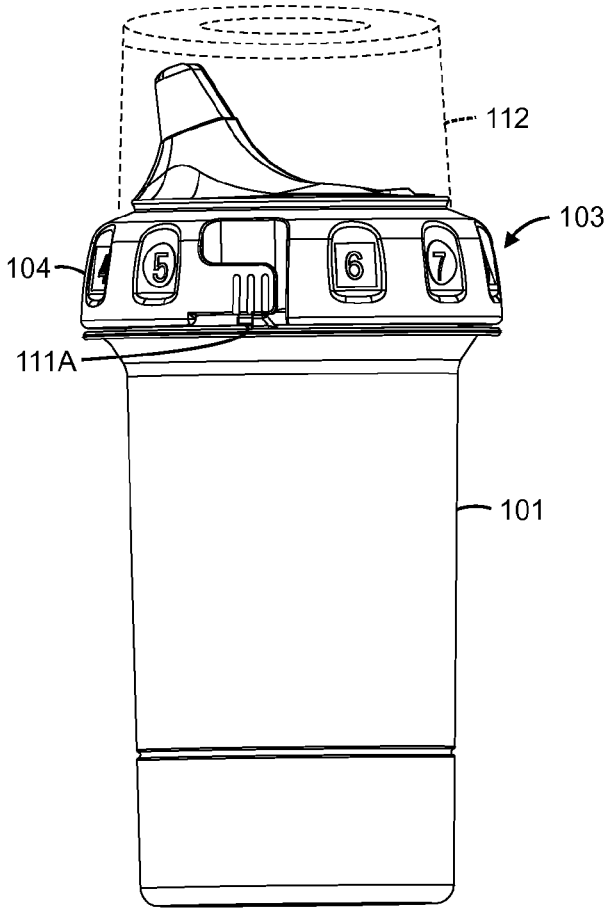
FIG. 1B shows a side view of the drinking apparatus of FIG. 1A with its optional transparent dust cover positioned on top of the cap.
Figure 1C:
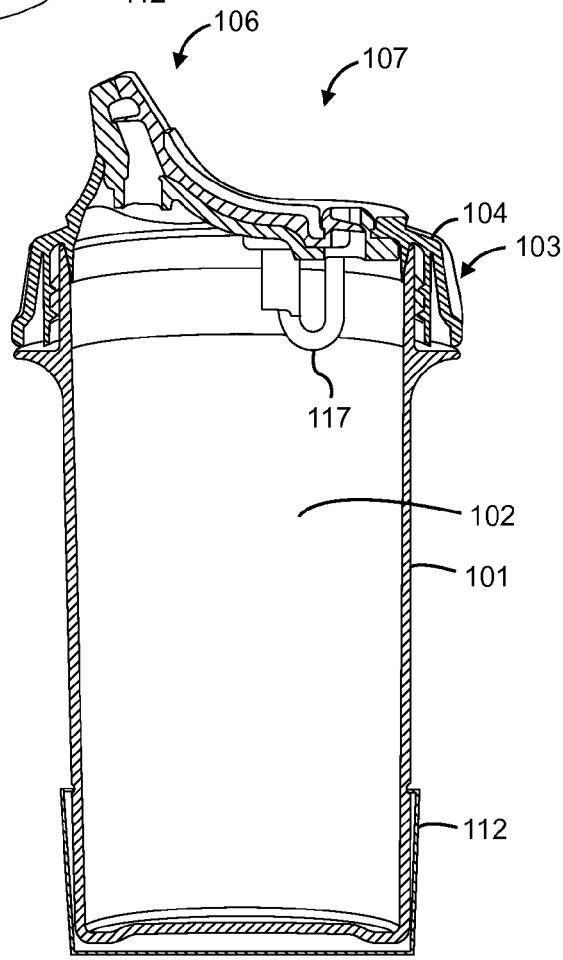
FIG. 1C shows a sectional side view of the drinking apparatus of FIG. 1A taken along the line c-c of FIG. 1A with the optional transparent dust cover positioned on the bottom of the cup base.

As mentioned in the background section above, there are many no-spill cup designs which may have disadvantages in one or more of the conflicting goals of (i) easy to drink from, (ii) hard to spill from, and (iii) easy to clean thoroughly and without losing parts. This detailed description first covers one initial embodiment. First, that initial embodiment is discussed in overview. Next the various structures making it up are described in detail. Operation of the valve assembly is discussed separately after its structure is presented. Finally, alternative versions and variations of designs are presented.

Initial Implementation

Overview

A particular, initially described version is illustrated in the several FIG. 1 through FIG. 6. In this version of a spill-resistant vessel, shown assembled in FIGS. 1A and 1B, a cup base 101 defines a cavity 102 for holding a liquid. The cup base shown is covered and closed by an attachable cap 103 which includes a lid cover 104 with two openings 108 109, a valve assembly 105, and a retention post 117. Some versions might have only one opening in their lid. The valve assembly of this version constitutes two separate valve mechanisms, one at either of its extremities. They are the liquid-out valve 106 and the air vent check-valve 107.

A mouthpiece 116 is integrated with the valve assembly and extends through the larger opening 108 on the lid cover 104. Similarly, the air inlet port 113 extends through the other lid cover opening 109 providing a path to equalize the ambient air pressure with the air pressure inside the cavity 102. The liquid-out valve 106 and the air vent check-valve 107 together allow liquid to be readily extracted by the user and are illustrated in the cross sectional view of FIG. 1C.

Having the two separate functions of controlling fluid flow and controlling venting within a common assembly, as in this example, provides a lower part count and increases the size of the smallest component, reducing the possibility of loss while cleaning or assembling. Other implementations might have these two functions implemented as distinct components or might use a design other than contemplated by this disclosure for one or the other function.

Figure 1D:
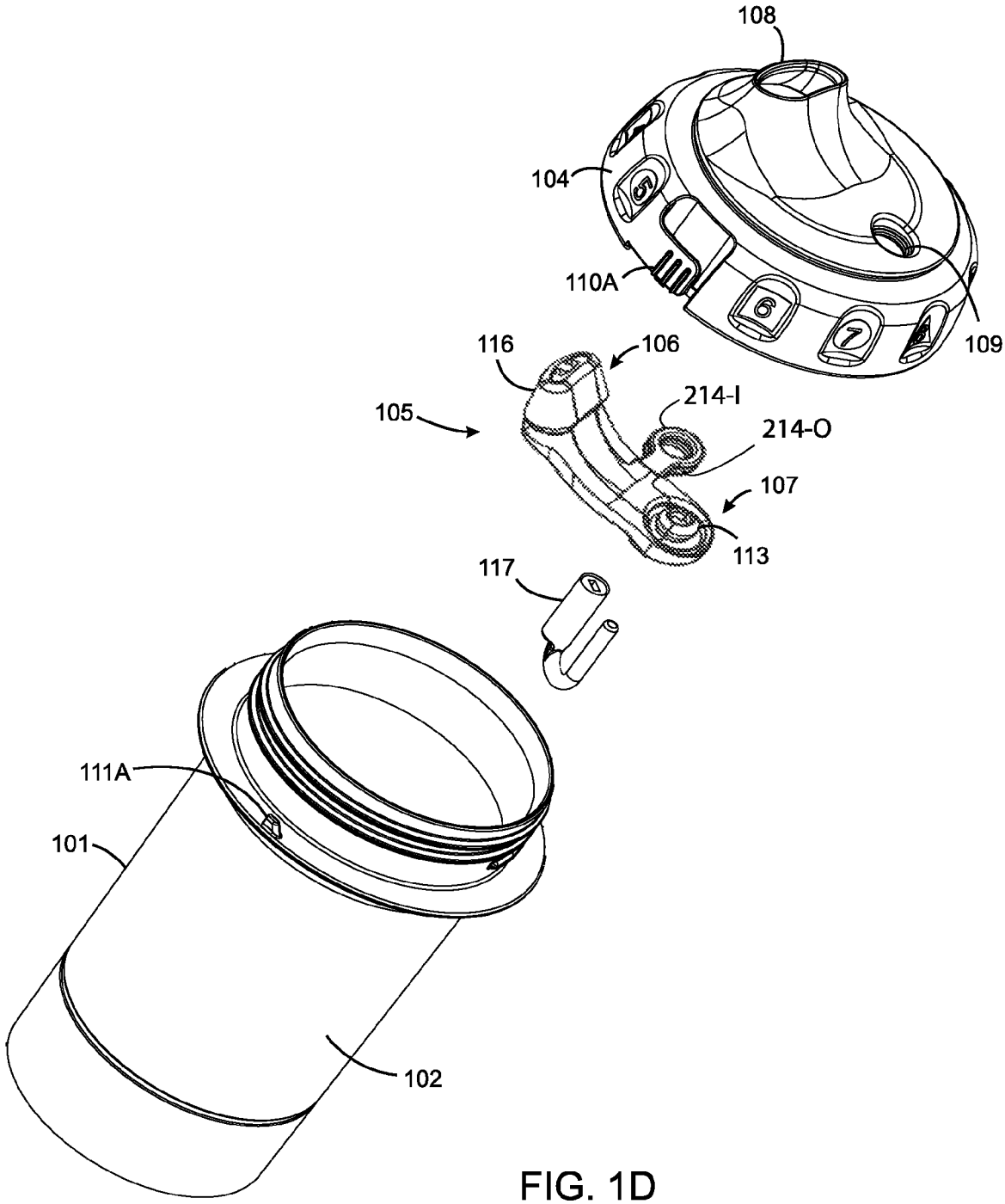
FIG. 1D shows an exploded perspective view of the non-spill drinking cup of FIG. 1A.

The cap 103 is sealingly attachable to the cup base 101 in a threaded manner and locks in place via two latch/tab sets, one on either side of the vessel. One set is the latch 110A on the lid cover engaging tab 111A on the cup base as seen in FIG. 1D, which shows an exploded view of the drinking vessel. The second latch/tap set is on the opposite side of the apparatus and is described in a section below. A hook-shaped retention post 117 is attached to or integral with the interior surface of the lid cover. One way to attach it is by ultrasonically welding. This post captures the valve assembly retaining rings 214-I 214-O. The post and the valve assembly it captures are also shown in FIG. 1D.

Initial Implementation, Valve Assembly—Structure

Figure 2A:
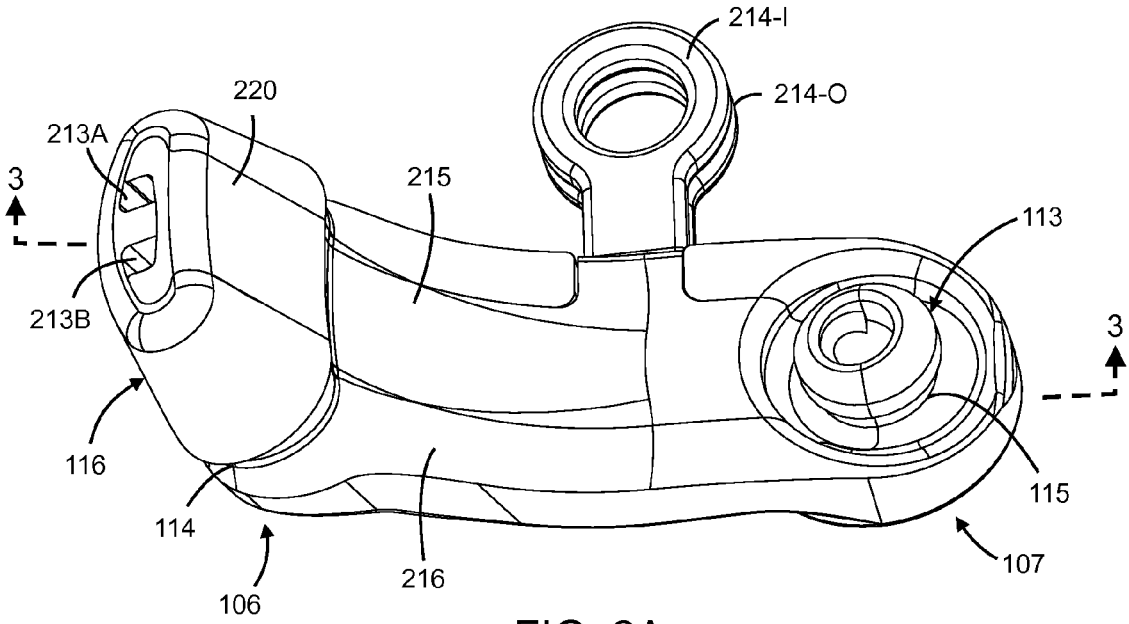
FIG. 2A shows a perspective view of the valve assembly of FIG. 1D.
Figure 2B:
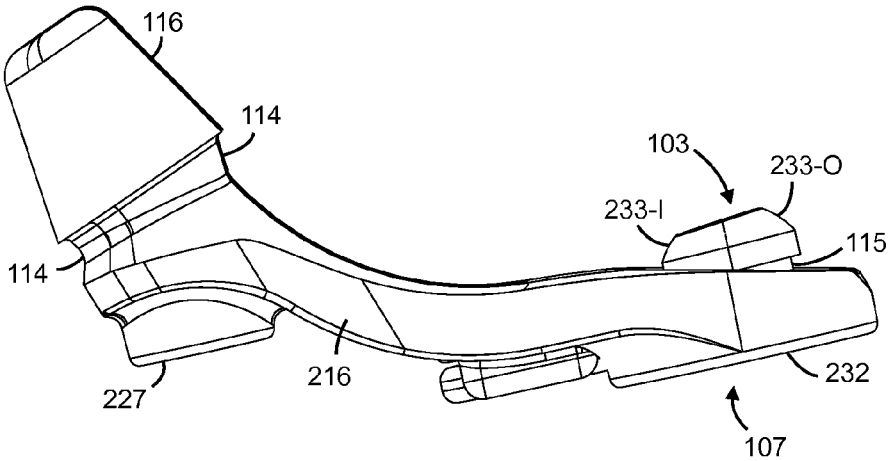
FIG. 2B shows a side view of the valve assembly of FIG. 2A.

The elongated valve assembly 105 of FIG. 1D is shown enlarged in FIGS. 2A and 2B. Both the liquid-out 106 and air vent valves 107 are together comprised by two molded parts: a common inner valve body 215 abutted to a common outer valve body 216. In this implementation both inner and outer bodies are composed of an elastomeric material. Food grade silicone rubber and Santoprene are some suitable rubber elastomeric materials. In this example, a material with a hardness between 0.50 and 0.70 durometer is used for the inner body and one of a hardness of between 0.60 and 0.90 durometer for the outer body. These hardness durometer values relate to the Shore A scale.

It can be advantageous to have the outer body 216 composed of a harder material than that of the inner body 215 to facilitate assembly and disassembly and to provide a stiffer structure for the mouthpiece 116. These abutted bodies are sealingly held together via force from the resiliency of each body pressing against the respective, opposing body's complementary shaped surface. While a component in the drinking vessel of FIG. 1A, this valve assembly 105 and valve assemblies related to it can be used with alternate lid and alternative cup designs.

Figure 2C:
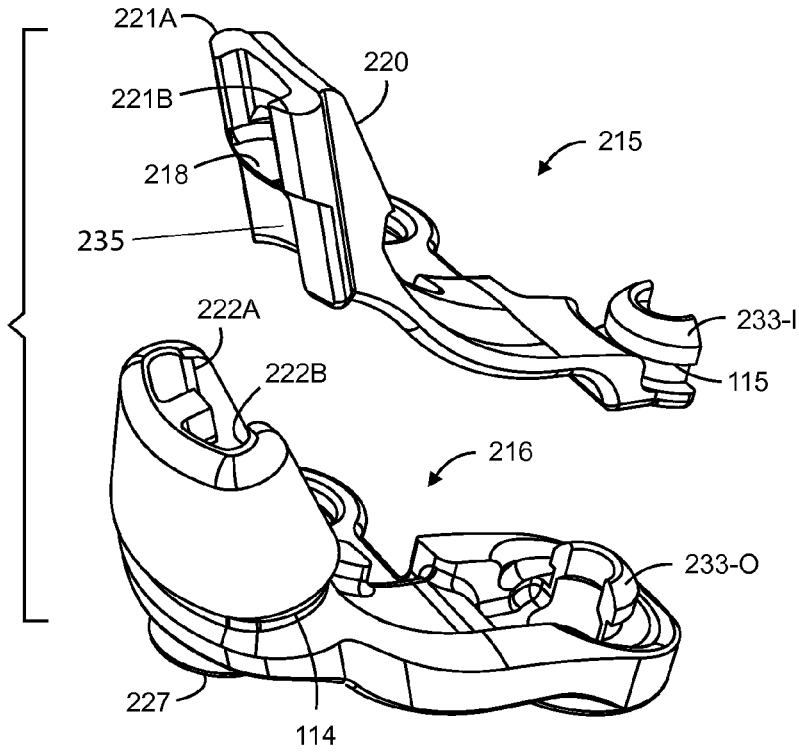
FIG. 2C is a perspective, exploded view of the valve assembly of FIG. 2A.
Figure 2D:
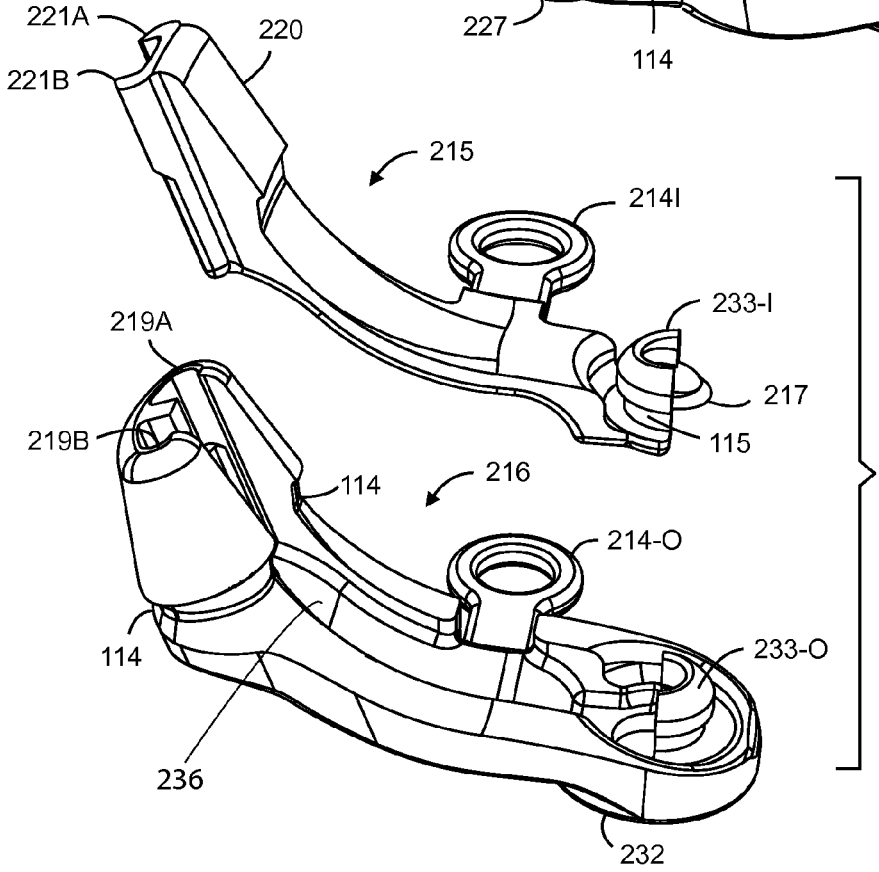
FIG. 2D is a perspective, exploded view as in FIG. 2C from an alternate vantage point.

FIGS. 2C and 2D illustrate this valve assembly showing the inner 215 and outer 216 valve bodies detached from each other. A fluid passageway or route is formed by the spaces between the adjacent faces 235 236 of the respective bodies. In this case, each face has a generally concave shape that, together, form an enclosed fluid channel. When detached, the liquid and air valves respective flaps 218 217 are exposed and furthermore the entire internals of both valves, including inlets, outlets, side walls, seats, and spout channels are opened. The former internal surfaces become external surfaces, facilitating cleaning without special equipment or techniques. There are no substantial impediments to the free flow of a cleaning solution over these surfaces. The inner and outer bodies are non-destructively attachable and detachable without tools or additional fasteners.

Liquid-out Valve Region

In FIG. 2A-2D the valve assembly is seen in various states and views. The spout, or mouthpiece 116, has two mouthpiece openings 213A 213B to convey liquid that flows through the two spout channels 219A 219B out to the user's mouth for drinking. When assembled, the mouthpiece openings constitute geometry of a size that could present cleanability issues. The spout channels, as formed in the face 236 of the outer body 216, are U-shaped, having one open side. When assembled, the relatively planar shaped channel seal 220 portion of the inner body's face 235 seals this open fourth side. Dovetail features 221A 221B shown in FIGS. 2C and 2D are on either side of the channel seal's surface that is intended to face the spout channels. Mating dovetail structures 222A 222B are on the outer body at either side of the spout channels. The mutually engaged dovetail structures provide a secure and watertight mouthpiece.

Pressing the spout into the larger opening 108 in the relatively rigid lid cover 104 serves to hold inner and outer valve bodies 215 216 mechanically tightly together. That attachment is by an annular notch 114 at the base of the mouthpiece being captured by the slightly undersized lid opening. Flow of liquid from the liquid inlet 227 out to the mouthpiece openings 213A 213B is regulated by the liquid-out valve flap 218 comprised on the inner valve body and seen in FIG. 2C.

Air Vent Check-valve Region

At the opposing end of the valve assembly is the air vent check-valve 107 shown in FIG. 1D. Although constituted by the same abutted inner 215 and outer 216 valve bodies as the liquid-out valve 106, the functions of these two valves are distinct and, in other implementations, could be constituted by distinct structures. An outer body inlet portion 233-O and an inner body inlet portion 233-I form the air inlet port 113, seen as a whole in FIGS. 2A and 2B. These structures are seen unassembled in FIGS. 2C and 2D. In its complete form the air inlet port might be considered as a small opening that might present cleanability issues. To provide an inlet area that is highly cleanable its inner surfaces are greatly more exposed in the disassembled state as seen in FIGS. 2C and 2D. Although lacking the dovetail structure of the liquid-out valve, the air vent valve end of the assembly is sealingly secured by the retention of the annular notch 115 at the collar of the air inlet in the appropriately sized smaller lid cover opening 109. Shown in FIG. 2D, the air vent valve flap 217 is constituted on the inner valve body 215. The air vent valve provides a conduit for air to flow into the cup's cavity through the air outlet port 232.

Optional Retention Ring Feature

The third functional element constituted by the inner and outer valve 215 216 bodies is their previously mentioned, respective, retention rings 214-I 214-O. An alternate lid cover or other large portion of a cap, or other large structure, might not employ a tethering feature at all, or might implement a variety of alternate tethering approaches to keeping the valve bodies from being dispersed after disassembly.

Mutual Attachment of Inner and Outer Valve Bodies

In order to facilitate proper alignment and reattachment of the translucent, elastomeric valve assembly components that might be used in this initial implementation, one or both of the inner and outer bodies are tinted a unique color. Alternatively, they could be marked with an indicum only in the vicinity of the dovetail mating surfaces. Other possibilities to assist orientation and reassembly include tactile features. Aligning the inner and outer bodies, shown in FIG. 2D, and pressing the seal 220 toward the spout channels 219A 219B can accomplish assembly. Alternatively, and preferably, aligning the bottom of the channel seal with its corresponding features at the mouthpiece openings and sliding the dovetail features together also can accomplish assembly.

Initial Implementation of Valves—Operation

Figure 3A:
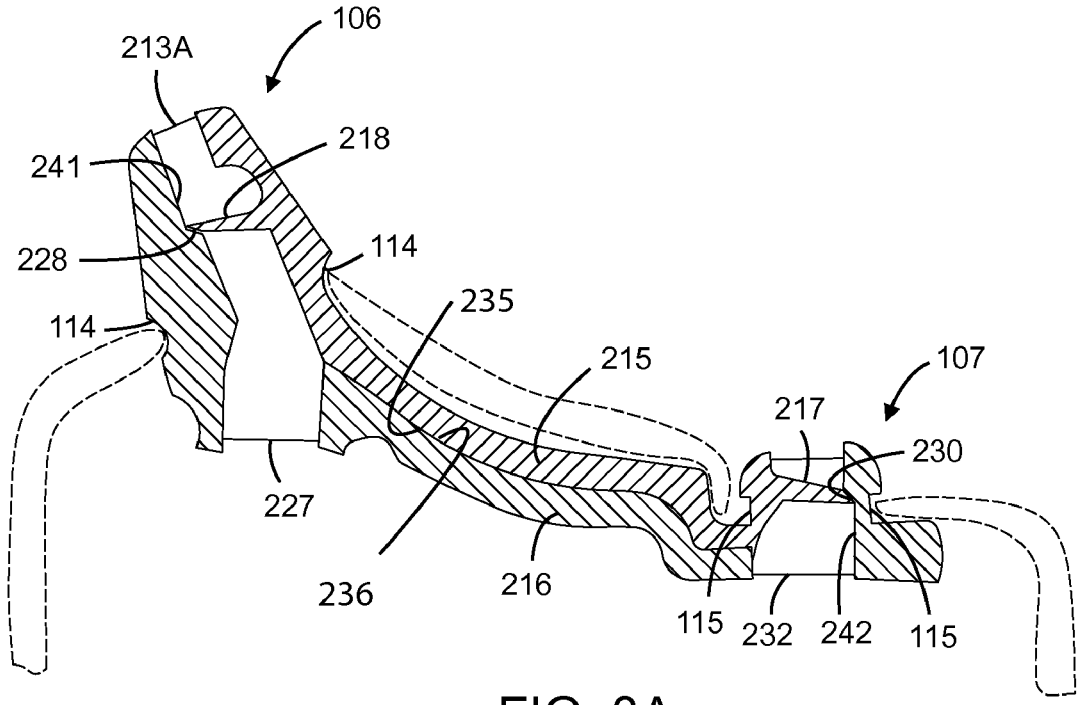
FIG. 3A is an offset, cross sectional view of the valve assembly of FIG. 2A along the line 3-3 in the schematically shown environment of a lid cover; the valves are in the normally closed position.
Figure 3B:
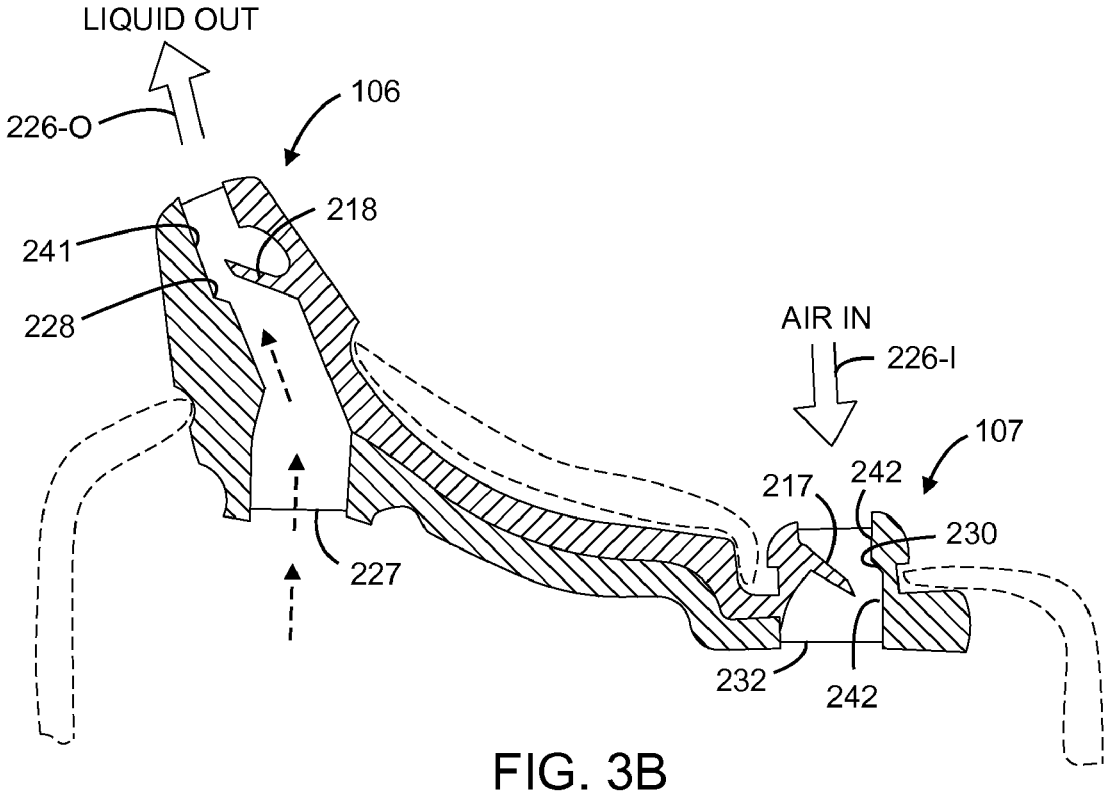
FIG. 3B shows the same sectional view as FIG. 3A but with the valves in the drinking position.

FIGS. 3A and 3B illustrate the operation of the valve assembly shown in the environment of a lid cover. The closed state is diagramed in FIG. 3A and the open state in FIG. 3B. In operation the liquid-out valve 106 enables an outward direction 226-O fluid flow path that includes an inlet port 227 and a thin area of hinged elastomeric material extending upward that constitutes the liquid valve flap 218. This flap is located such that it is biased to sit in a valve seat 228 against the opposite side valve wall 241 as seen in FIG. 3A. The flap restricts liquid from entering the spout channels 219A 219B and out to the user unless the flap is acted upon by an appropriate force. In this case, that is accomplished by the user creating a pressure differential between the cup cavity and the openings 213A 213B of the mouthpiece. In a child's no-spill cup the pressure differential would be from the user sucking on the mouthpiece. In other cases, a sports bottle for example, it could be from squeezing a flexible portion of the cup base.

Similar to the case of the liquid-out valve 106, the air vent valve flap 217 is biased against its valve seat 230 in the opposite side valve wall 242, shown in FIG. 3A. However, that air vent flap is inverted in comparison to the liquid-out valve flap 218 since it is regulating flow in the opposite direction 226-I. If there is no effective difference in air pressure between the external environment of the cup and the cup's cavity the flap of the air vent valve is designed to restrict liquid from traveling through it and leaking out of the air vent inlet port.

As mentioned above, to extract liquid and drink, the pressure is made greater on the inside of the cup than at the end of the mouthpiece. As shown in FIG. 3B, the liquid-out valve 106 will open by the flexing of the resilient flap 218 away from its valve seat 228. An open liquid-out valve allows fluid outflow in a direction 226-O towards the drinker's mouth. That fluid flow reduces the air pressure in the cavity to less than ambient pressure, which in turn opens the air vent valve by flexing its resilient air vent flap 217 away from its valve seat 230. The open air vent channel will then let the pressure equalize between the ambient and the cavity by air moving in direction 226-I. Equalized pressure facilitates continued liquid extraction by the user.

Initial Implementation Cap Assembly—Structure & Operation

As used in this description, "cap" refers to an assembly that includes the lid cover, the valve components, and any ancillary parts (such as the retention post or other attachment components) related to either. Since a cap may be used with cup bases other that of the initial implementation, it is useful on its own. Cap underside (also called its interior side) views are seen in the several FIGS. 4A-4C and FIGS. 5A-5D.

As described above, this initial version's valve assembly 105 is composed of elastomeric materials. When inserted in the openings 108 109 in the lid cover this arrangement provides both an attachment between the valve assembly and the lid cover 104 and watertight seals between the cavity and the external environment. The resilient material of the valve assembly is compressed in the lid cover openings, creating the seals. Due to the annular notches 114 115 in the valve assembly and the shape of the spout and air valve inlet port 113 this attachment has a positive detent and is harder to remove from the lid cover 104 than it is to install. Difficulty in pushing the valve assembly down into the cup from the outside contributes to the childproof and spill-proof nature of the apparatus.

Figure 4A:
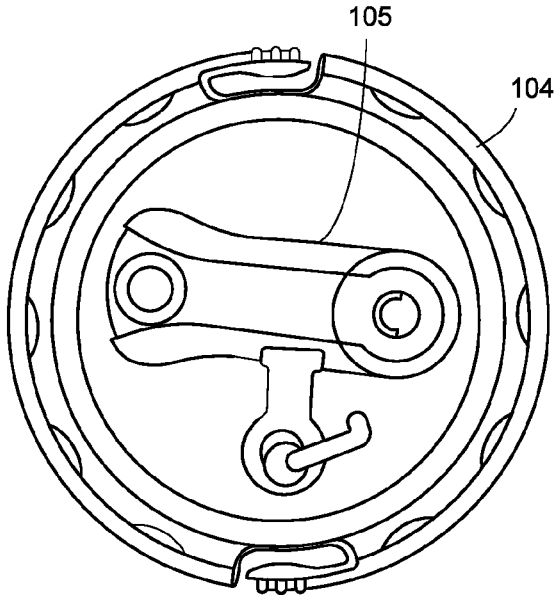
FIG. 4A shows the underside of the cap.
Figure 4B:
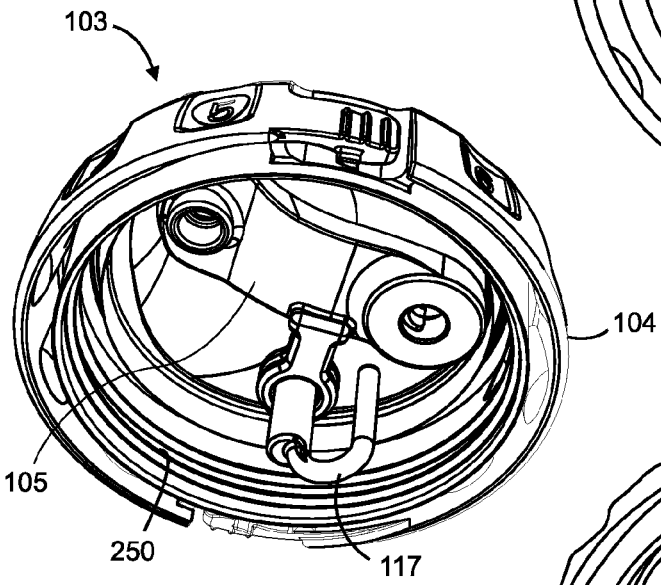
FIG. 4B shows a perspective view of the underside of the cap assembled in configuration for use.
Figure 4C:
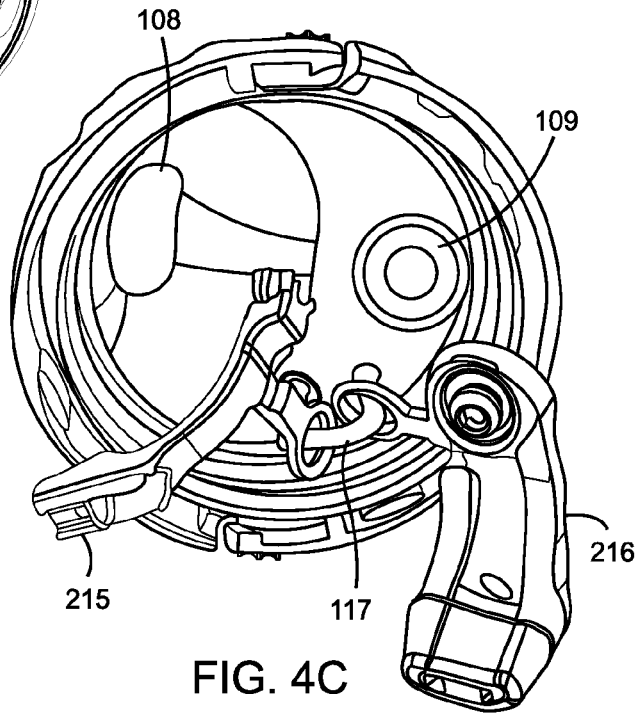
FIG. 4C shows a perspective view of the underside of the cap in cleaning configuration.
Figure 5A:
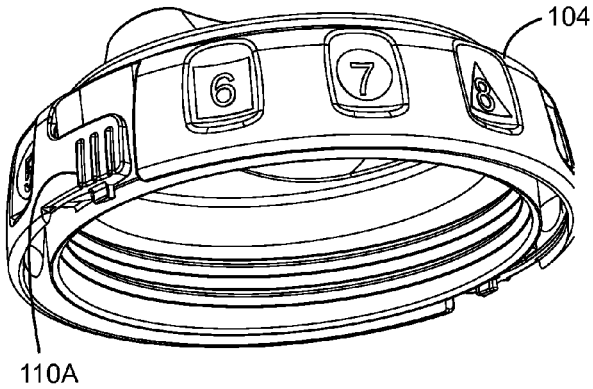
FIG. 5A shows a perspective view of the cap showing one latch.
Figure 5C:
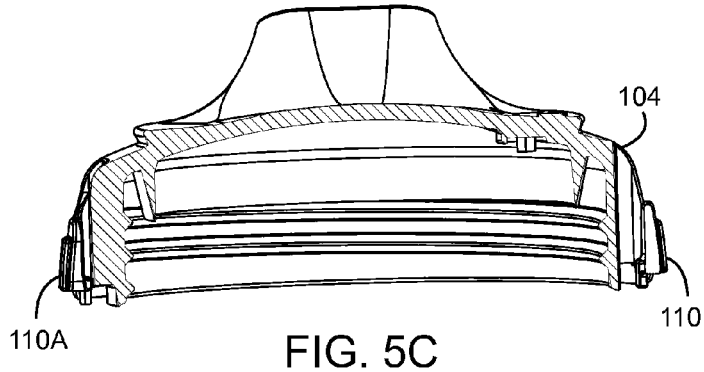
FIG. 5C shows a cut-away of the lid cover along the line X-X of FIG. 5B.
Figure 5B:
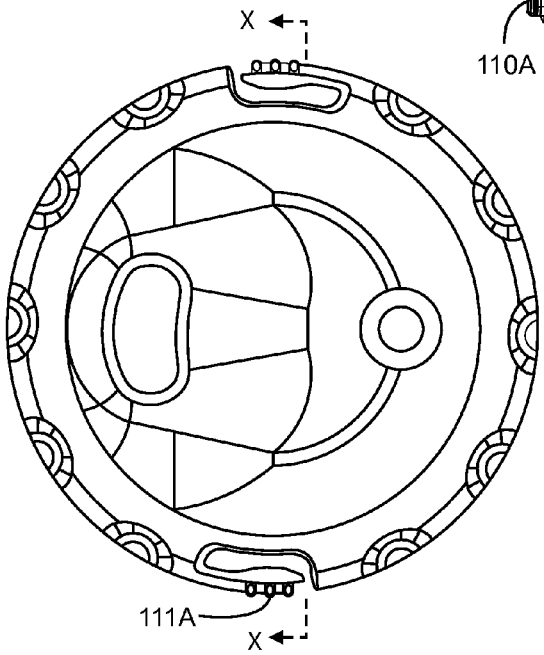
FIG. 5B shows a plan view of the lid cover showing both latches.
Figure 5D:
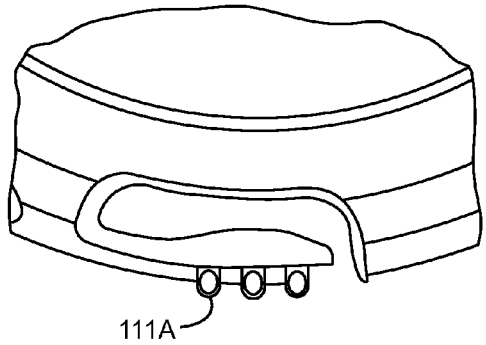
FIG. 5D shows an enlarged fragmentary view of the latch area of FIG. 5B.

Once the cap is removed from the cup base it is relatively easy to pull the valve assembly out of the lid cover from its underside or interior facing side. In the cap shown in FIG. 4B, this is readily accomplished by putting a finger under the central portion of the valve assembly at a point opposite the retaining rings, then leveraging against the lid cover to remove the valve assembly. This is the first step to transform the device to the cleaning configuration of FIG. 4C in which the openings 108 109 are cleared and the inner 215 and outer 216 bodies are separated and exposed. To separate the inner body from the outer body as shown in FIG. 4C, the inner body is peeled from the outer body.

Another feature of the cap that was previously mentioned is tethering. An aspect of this cap's tethering structures is that the inner and outer valve bodies are linked with sufficient looseness and freedom of movement to not create any hard-to-clean traps for milk. It also provides enough freedom of movement to allow valve components to substantially move away from the lid cover's surface for mutual separation for cleaning access as shown in FIG. 4C. In an alternate version of a cap the subcomponents might be only tethered to each other or possibly tethered to a distinct structure sized and shaped to resist falling through a rack of a dishwasher. Tethering can allow subcomponents to be handled as a single item for cleaning and storage purposes. In still other versions there may be no tethering at all.

Initial Implementation—Cup to Cap Connection

Figure 6A:
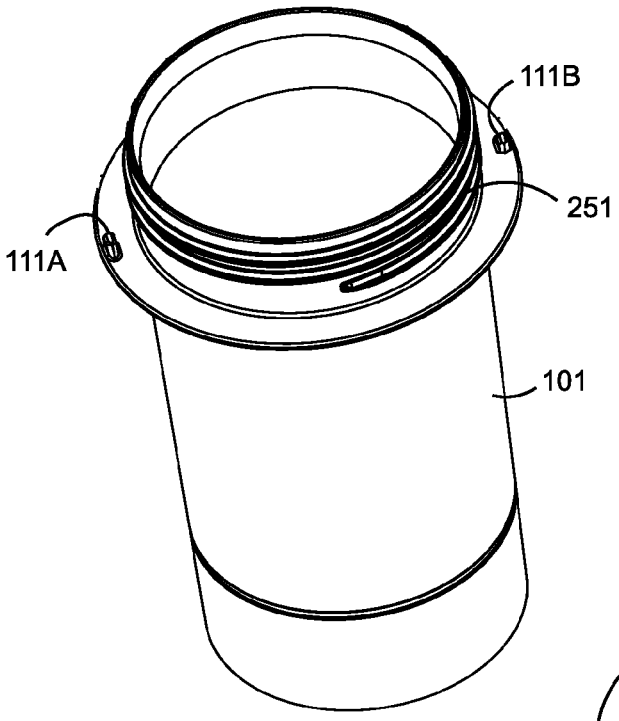
FIG. 6A illustrates a cup base in perspective, showing both tabs and its open top.
Figure 6B:
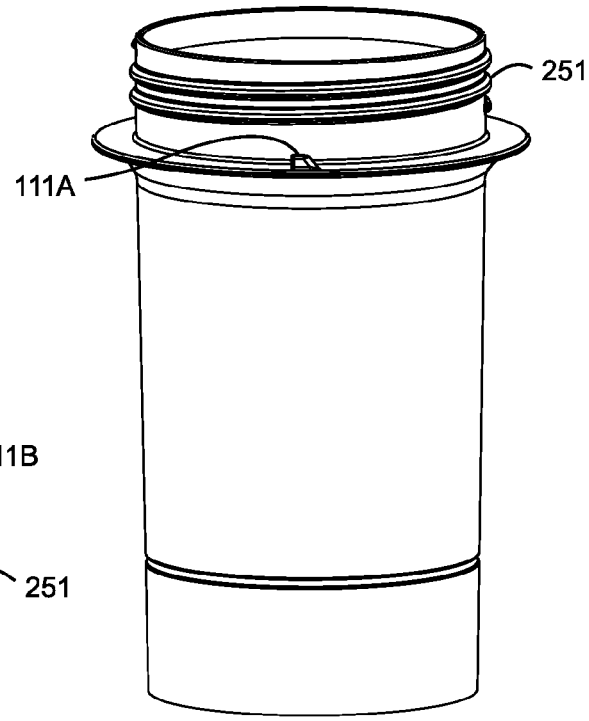
FIG. 6B shows a cup base from the side.
Figure 6C:
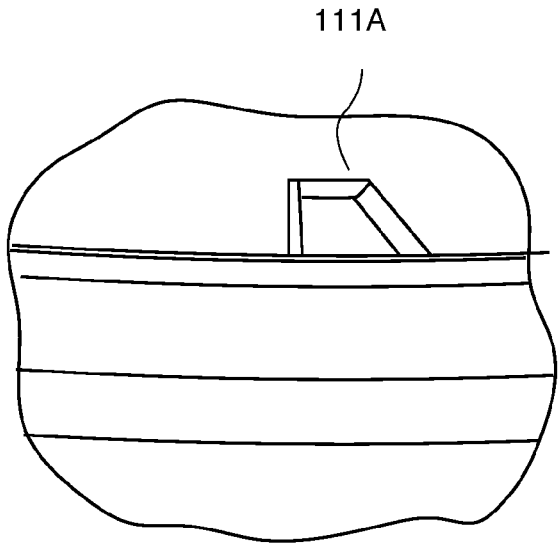
FIG. 6C illustrates an enlarged fragmentary view of FIG. 6B, showing a tab.

The threaded and latched manner of securing the cap to the cup base contributes to prevention of spilling. In the presently discussed version and as seen in FIGS. 6A and 6B, internal threads 250 of the cap engage the external threads 251 of the open end of the cup base. This provides a secure and watertight covering of the cavity. The cap removal is baby-proof by requiring simultaneous, opposite direction, pressing on both sides to release the two latches 110A 110B, and then turning. Further, the latches 110A 110B seen in FIGS. 5A, 5B and 5C and their mating tab features 111A 111B seen in FIG. 6A, 6B and 6C are configured to produce an audible sound and a tactile, vibratory, sensation when the cap is properly closed. The user can know without thinking about it that the cover is properly attached via a readily detectable indication. Other implementations might employ indica other than a mechanically caused auditory one. Other indications of complete closure might include a change in color or indication via extended vibration or by light or by an electrically produced sound for example. Still other versions might dispense with locking mechanisms.

Cleaning Method

To confidently clean the narrow passageways, small holes and slits often found in such cups it might be advisable to disassemble, pre-wash with a small brush, possibly put the parts in a basket to keep them from falling through spaces in a rack and then put in a dishwasher. To clean many units consistent with this teaching all that is required is the actions of: (1) remove cap and (2) free the valve assembly from the lid cover, (4) peel the inner valve body portion from the outer valve body portion, (5) wash in a household dishwasher or otherwise wash as most other household food and drink serving and food preparing items are washed.

Alternate Implementations

This teaching encompasses many variations from the initial implementation. One category of variations of would be providing the subcomponents of the initial implementation at alternate levels of integration. For example, an apparatus consistent with this invention could consist of only the cap, possibly adapted to attach to a generic cup base. Another apparatus would be just the valve assembly itself. A third would be the cup provided as a kit of unassembled parts. While a flap valve shaped as a "duck bill" is shown in the illustrated examples, other valve types such as umbrella valves and those of other shapes such as disks might also be employed to block, control, regulate or otherwise interfere with the path of a liquid or gas.

A lid could connect to a cup base in many alternate ways including friction, and a bayonet mount. A spring bale and a gasket similar to those of a canning jar, as well as other alternatives to make a mechanically secure and watertight attachment could be used.

Figure 7:
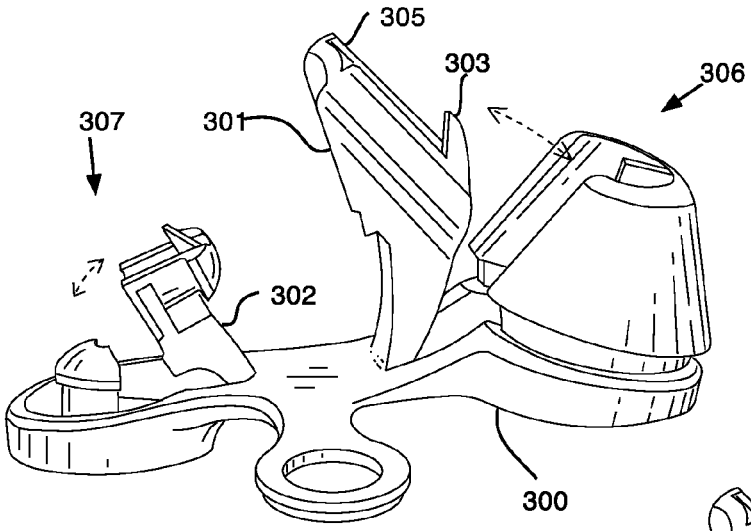
FIG. 7 illustrates an alternative valve assembly embodiment composed of a single molded part in which two generally solid triangular sections are hinged to a main body.

While the initial valve assembly implementation presented herein is constructed by attaching two separate molded elastomeric bodies, FIG. 7 shows an alternate version made as a single molded part having three sections. The largest section is the main body 300 that serves as the outer body. The two smaller sections are each of a generally solid triangular shape. One serves the inner body 301 function for the liquid out valve 306, while the other serves as the inner body 302 for an air vent valve 307. The liquid valve's inner body section 301 of the unitary valve assembly includes a channel seal 305 and a liquid valve flap 303. Hinging this section towards the main body completes the liquid-out valve and mouthpiece by bringing two surfaces into adjacency. Similarly, the air vent valve 307 is created by the interface between the other triangular shaped hinged section 302 and the main body 300 of the unitary molded component.

When both hinged sections are pressed into the main body section of this valve assembly the resulting device resembles the initially described valve assembly 105 in its assembled state. When the triangular sections are hinged out, as in FIG. 7, the interior areas are exposed, made accessible, and exterior.

Figure 8:
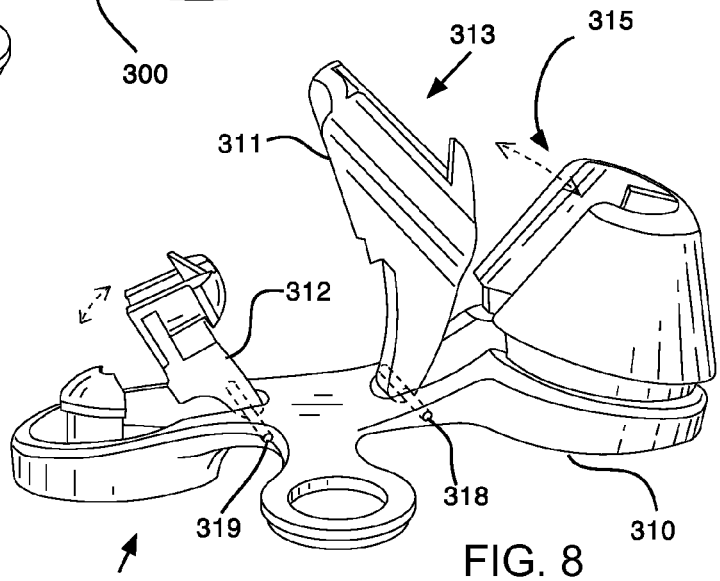
FIG. 8 shows an alternative valve embodiment composed of three distinct parts in which two of the parts are hinged by pins to a main body part.

Somewhat similar to the one-piece valve assembly of FIG. 7 is the three-piece design seen in FIG. 8. In this version the two triangular inner bodies 312 311 of the assembly are distinct, individual elastomeric parts. They are held in position and hinged by pins 318 319 inserted through the base outer body 310. By hinging those triangular bodies in and out this version of a valve assembly can be transformed from cleaning to usage modes. For example, when the liquid valve inner body component 311 is pressed toward the mouthpiece aspect of the base outer body component 310 two surfaces 313 315 are abutted. Their interface forms a liquid-out channel, valve, and mouthpiece. The valve assemblies of FIG. 7 and of FIG. 8 could be used with the initially described lid cover or could be mounted in a different manner.

Figure 9:
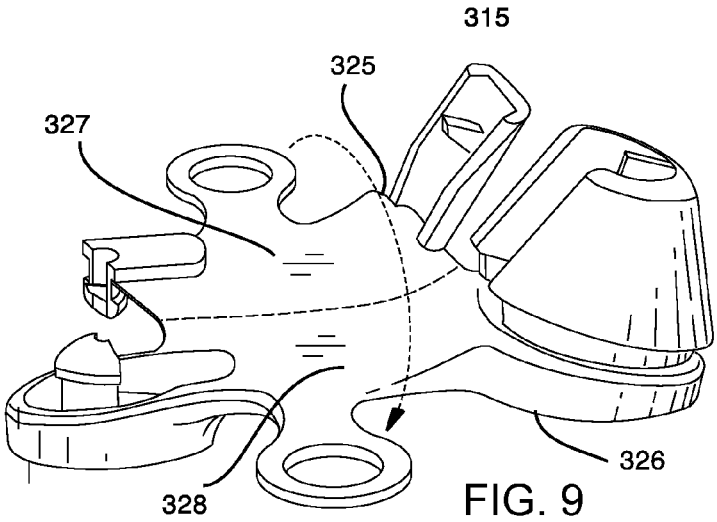
FIG. 9 shows an alternative embodiment of a valve assembly composed of one molded part which folds over onto itself to be transformed to a usage configuration.

Another version of a valve assembly also constituted in a unitary molded part is shown in FIG. 9. It is similar to the initially described version but its inner 325 and outer 326 body aspects are constituted in a single component. To assemble into usage mode, the inner valve body aspect is folded over the outer body aspect bringing two opposing faces 327 328 into very close adjacency with some portions abutted. The surfaces are locked in place by the resilient force exerted on interlocking portions of their respective structures.

Figure 10:
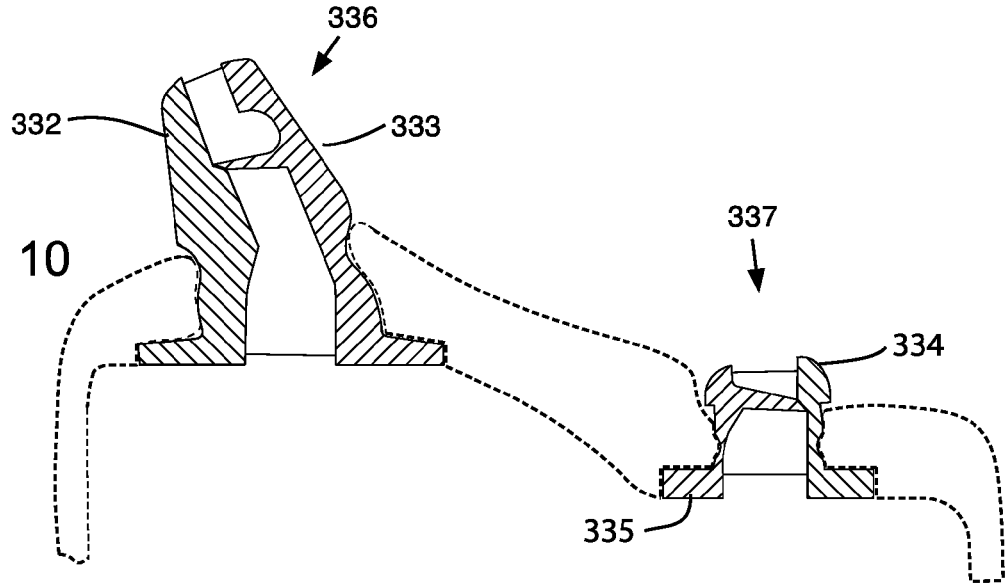
FIG. 10 shows a sectional view as in FIG. 3A but of an alternative embodiment in which the liquid-out and air vent valves are separate assemblies.

As mentioned earlier, a liquid-out valve and an air vent valve could be distinctly, rather than commonly, and integrally, constituted. In FIG. 10 a version is shown in which each of the valves is composed by the interface of two elastic body members but those pairs of members are distinct from one another. One pair 332 333 creates the liquid out valve while a different, secondary, pair called the vent-valve inner body 324 and the vent-valve outer body 335 constitute the air vent-valve 337. Additionally, one or the other of these valves could be replaced by technology other than that of the teaching of this disclosure. Particularly, there are applications in which an air vent valve of a different technology might be used and some cases in which an air vent valve might be omitted. A sports bottle design, for example, might not have an air vent valve. Other versions might have multiple openings for liquid or gas communication.

In the previously discussed versions, the resilient or elastic properties of the valve bodies accomplished at least three tasks: (1) holding the faces together in a watertight manner, (2) holding the valve assembly sealingly and mechanically to the lid cover, and (3) providing a spring-loaded, hingeably mounted, moving part to block or to not block a potential flow. The first two tasks can be accomplished in ways not dependent upon a valve body being composed of an elastomeric material. Added fastening components and gaskets could be employed to both hold inner and outer bodies together and to hold a valve assembly sealingly in a lid cover. Another alternative would be for a lid cover to have a soft resilient portion at its openings that sealed against a relatively hard portion of a valve assembly.

Alternatively, the inner body could be composed of an elastomeric material and the outer body composed of a rigid material. The flaps, constituted on the inner body, would then, appropriately, be of elastomeric material. The resilient force of the inner body against a hard outer body could provide a sealing attachment and a watertight fluid pathway. In another example, both bodies might be of a rigid material and be held together, and to a lid, by clips, clamps and gaskets. A resilient material might then be used only in the moving part flow-blocking aspect or as gaskets.

In some devices consistent with the principles taught herein a lid might have only a single hole. That hole could accommodate a liquid-out valve of the present teaching. In a sports bottle embodiment, for example, the equalization of air pressure might occur due to a liquid-out valve that is not gas-tight.

Implementations presented above have a structure to selectively block a flow that is held in a closed position until acted upon by an appropriate force. In those previously presented versions, that force was generated by a pressure differential that moved a hinged, resilient flap. In other versions, the force might be from a manually actuated source or engendered by an electric actuator.

Drawtube

Figure 11:
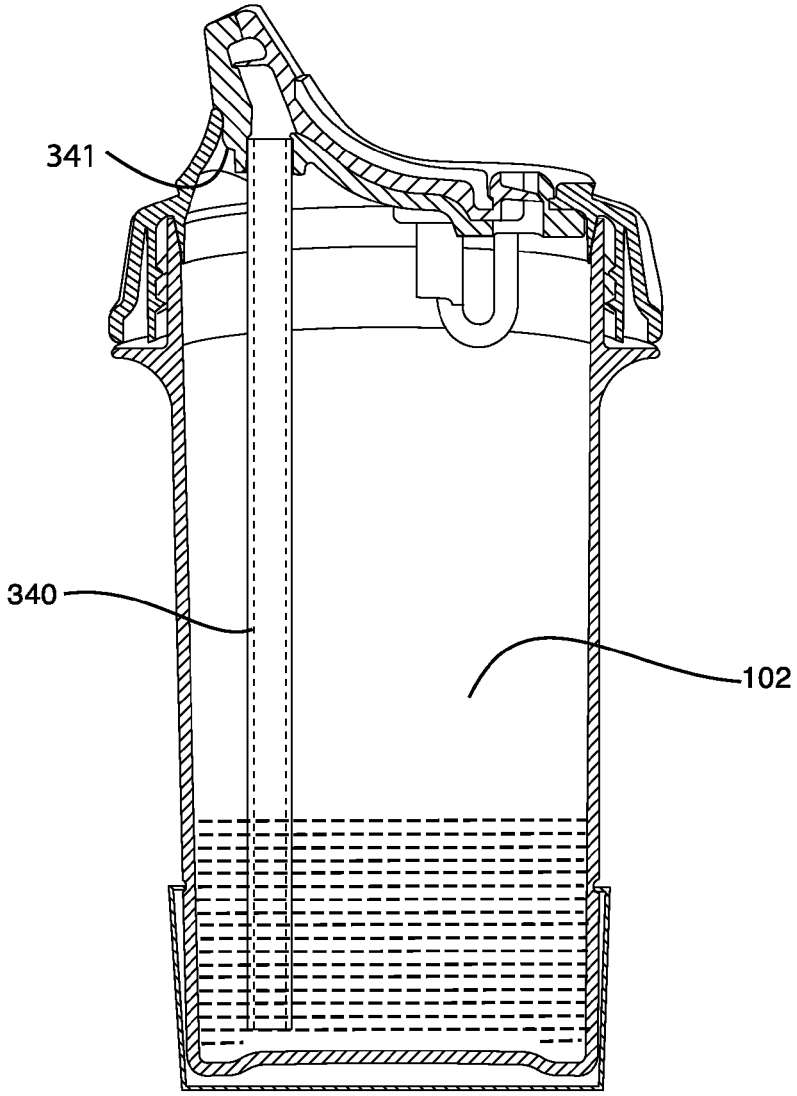
FIG. 11 shows a sectional view of the initial implementation as in FIG. 1C and adds a new element to the cup.

An element that might be added to many versions consistent with the present teaching is a drawtube 340 shown in FIG. 11 in the context of the initially presented implementation. The drawtube is fitted into a specially adapted liquid-out inlet port 341, acting as a functional extension to the inlet. This design allows a lower drinking angle when the cavity is less than full of liquid. If the drawtube were constituted by a standard drinking straw, the cleanability properties of a particular version of an apparatus would not be compromised by its use, since a straw is disposable.

Those skilled in the art will recognize that the embodiments described herein are readily producible using known techniques, materials and equipment. This teaching is presented for purposes of illustration and description but is not intended to be exhaustive or limiting to the forms disclosed. Many modifications and variations will be apparent to those of ordinary skill in the art. The embodiments and versions help to explain the principles of the invention, the practical application, and to enable others of ordinary skill in the art to understand the invention.

Various embodiments with various modifications as are suited to the particular use contemplated are expected. In the following claims, the words "a" and "an" should be taken to mean "at least one" in all cases, even if the wording "at least one" appears in one or more claims explicitly. The scope of the invention is set out in the claims below.

We claim:

1. A no-spill drinking cup comprising:

(a) a vessel having a cavity with an open end;

(b) a lid cover, attachable to said vessel for closing the open end of said vessel's cavity; when in a closed state, said lid cover constituting a boundary defining an interior and an exterior of said cup; said lid cover defining at least one opening for allowing liquid communication from the interior to the exterior of said cup;

(c) a valve assembly attached to said lid cover and configured in relation to the at least one opening such as, when said lid cover is closing said vessel's open end, to provide a controlled liquid communication route from the cavity of said vessel to the exterior of said cup, said valve assembly comprising:

one or more valve bodies for liquid control, said bodies collectively having at least two faces and at least one of said valve bodies being comprised of an elastic material;

said one or more valve bodies for liquid control being arrangeable to bring said at least two faces into mutual adjacency with portions in mutual sealing abutment, such that the faces create an interface;

the interface between the at least two adjacent face portions defining an enclosed channel comprising:

an inlet for accepting fluid from the cavity, an outlet for dispensing fluid to the exterior of the cup, and a conduit connecting said inlet to said outlet and configured to provide fluid communication from said inlet to said outlet;

said valve assembly further comprising:

a flap constituted on the at least one valve body composed of an elastic material, said flap configurable within the channel such that said flap selectively blocks the fluid communication;

the abutted portions of the at least two faces, being separatable along a path parallel to the conduit and extending from the inlet to the outlet such that, when separated, the surfaces of said flap and all formerly interior surfaces of the channel become exposed, exterior surfaces.

2. The no-spill drinking cup of claim 1 in which said valve assembly is non-destructively detachable from said lid cover.

3. The no-spill drinking cup of claim 1 wherein said flap is so shaped, constituted, and configured to be responsive to a pressure differential between the environment of the cavity and the environment of the outlet, such that a relatively lower outlet air pressure urges flap deflection in a manner allowing fluid communication from said cavity to said outlet.

4. The no-spill drinking cup of claim 1 further comprising a valve seat, and wherein the selective blocking of fluid communication is effectuated by said valve flap being biased against said valve seat when in a ready-to-use state.

5. The no-spill drinking cup of claim 1 limited by said lid cover further defining at least one distinct air opening for allowing flow of air from the exterior of said cup to the cavity.

6. The no-spill drinking cup of claim 5 further comprising:

an air valve assembly attached to said lid cover and configured in relation to the at least one air opening such as, when said lid cover is closing said vessel's open end, to provide a controlled gas communication route between the exterior of said vessel and the cavity, said air valve assembly comprising:

one or more air valve bodies, said air valve bodies collectively having at least two faces, and at least one of said air valve bodies being comprised of an elastic material;

said one or more air valve bodies being arrangeable to bring said, at least two faces of air valve bodies, into mutual adjacency with portions in mutual sealing abutment, such that these faces create an interface for air control;

the interface between the at least two adjacent air valve bodies face portions defining an enclosed air channel comprising:

an air inlet, an air outlet, and an air conduit connecting said air inlet to said air outlet and configured to provide gas communication between said air inlet and said air outlet;

said air valve assembly further comprising:

an air flap constituted by the at least one air valve body composed of an elastic material, said air flap configured within said air channel such that said air flap selectively blocks air communication;

the abutted portions of the at least two air valve faces configured to be separatable along a path parallel to the conduit extending from the inlet to the outlet such that, when separated, the surfaces of said air flap and all interior surfaces of said air channel become exposed, exterior surfaces.

7. The no-spill drinking cup of claim 6 wherein said valve bodies for liquid control are integral with said air valve bodies, and further, that the geometry of the liquid out valve's mutually abutable face portions are mutually complementary, and, the geometry of the air valve body's mutually abutable face portions are also, respectively, mutually complimentary;

further each of said integrated bodies are substantially composed of an elastic material with effective degrees of hardness such that the mutually complementary geometry of their respective two or more faces cleave sealing together in a watertight manner, without the requirement of additional sealing or retaining structures; and wherein by integral is meant that a sidewall of the liquid conduit is unitarily formed with a sidewall of the air conduit.

8. The no-spill drinking cup of claim 3 wherein said valve bodies are substantially composed of a rubber material with a hardness of between 0.40 and 0.90 durometer on the Shore A scale.

9. A spill resistant cup with a lid, a mouthpiece. and a valve for regulated liquid dispensing, both valve and mouthpiece each having an enclosed liquid pathway, the improvement comprising:

said valve and mouthpiece are integrated in that a sidewall of the pathway of the mouthpiece is unitarily formed with a sidewall of the pathway of the valve: further, they are comprised by one or more elastomeric bodies; said bodies collectively having two or more sealingly abutable, and separatable faces, at least one of the faces having a generally concave feature;

further, all non-disposable portions of said enclosed liquid pathways are defined by spaces between the abutted faces, and all liquid contacting surfaces of said integrated mouthpiece and valve become external, exposed surfaces when the faces are separated.

10. The spill resistant cup of claim 9 further comprising indicia on at least one of said elastomeric bodies; such indicia suitable to aid a user in the sealing abutment of separated faces.

11. The spill-resistant cup of claim 9 wherein said one or more elastomeric bodies are exactly two elongated elastomeric components.

12. A flow control apparatus for regulating the flow of fluid in a dispensing container comprising:

a fluid-conducting passageway defined by internal sidewalls, having an inlet and an outlet and including a valve having at least one moving part for selectively blocking said passageway's fluid flow;

said passageway's internal fluid-contacting regions being defined by the interface between two or more adjacent surfaces, said adjacent surfaces being separatable along a re-sealable longitudinal seam extending from inlet to outlet;

further, when separated along the seam, the apparatus is reversibly placed into a stable, cleaning configuration in which the formerly internal liquid-contacting sidewall regions of the passageway become external exposed areas providing for effective cleaning.

13. The flow control apparatus of claim 12 further comprising a vent-valve for equalizing air pressure thereby facilitating the dispensing of liquid.

14. The flow control apparatus of claim 12 wherein said adjacent surfaces are aspects of one or more molded elastomeric bodies.

15. The flow control apparatus of claim 14 wherein the adjacent surfaces are constituted on a single common molded elastomeric body.

16. A flow control apparatus of claim 14 further comprising, in combination, a lid attachable to said fluid-conducting passageway.

17. The flow control apparatus of claim 12 further comprising one or more small holes, or optionally slits, as one or more flow-restriction features wherein a re-sealable seam bisects each of the one or more flow-restriction features such that, when the apparatus is opened along the seam to a stable cleaning configuration, opposing sides of each flow-restriction feature reside on opposing sides of the open seam providing for effective cleaning of the opposing surfaces of the flow restriction features.

18. The flow control apparatus of claim 11 wherein small openings and slits are further limited to those with any non-depth dimension smaller than about 6 millimeters.

19. The flow control apparatus of claim 17 wherein bisects means a substantially 50/50 division.

20. A non-spill cap for a drinking cup comprising:

a lid, operationally connectable to a a spout, and said lid also operationally connectable to a valve, said valve providing for a controlled flow of liquid through said lid and out said spout in which all non-disposable liquid-contacting areas of said spout and said valve are non-destructively, manually, transformable into a cleaning configuration in which a majority of the non-disposable liquid contacting areas are exposed for cleaning;

further, when in said cleaning configuration, said lid, spout, valve, and any other liquid contacting structures of said cap are mutually connected to each other or otherwise constitute a single item for handling purposes, wherein fully exposed for cleaning means as readily cleanable as household food serving items are generally.

21. The cap of claim 20 wherein small openings and slits are further limited to those with any non depth dimension smaller than about 6 millimeters.

22. The non-spill cap of claim 20 wherein a cleaning configuration is one free of all small holes and slits and wherein the limitation of a majority of the non-disposable liquid-contacting areas are exposed for cleaning is further limited to all of the non-disposable liquid contacting areas are fully exposed for cleaning; and further wherein small opening and slit means those that are too small to be as readily cleanable as household food serving items are generally.

23. A drinking vessel comprising:

(a) means for holding liquid in a defined space having an open end, (b) means for substantially covering the open end of said defined space, (c) means for allowing a controlled flow of liquid from said defined space, through said means for covering the open end;

said means for allowing a controlled flow comprising a liquid-conducting route and a moving part to interfere with that route;

further, said means for allowing a controlled flow comprising two or more elongated, elastic members for collectively defining all non-disposable portions of said liquid-conducting route by their mutual interface, such that all non-disposable surfaces defining said liquid conduction route are completely accessible for cleaning when said members for defining the route are separated from each other;

completely accessible for cleaning includes the property that there are no substantial impediments to the free flow of a cleaning solution over and past all surfaces requiring cleaning and that no small fluid-restricting holes or interior surfaces remain.

24. A child-proof spill-resistant child's drinking cup minimizing loose parts comprising:

a) a cavity with an open end, b) a cover for sealingly closing said cavity's open end, said cover attachable to the open end of said cavity in a sealingly locked fashion, when so attached, said cover defining the cavity as an interior region and an the outside of said cup as an exterior region; and said cup producing a user detectable indicium when said cover becomes locked;

locked means that at least two contemporaneous forces in different directions are required before allowing said cover to unseal the open end of said cavity, c) a conduit providing selective liquid communication from said interior region, through said cover, to said exterior region;

said cover, when disassembled for cleaning, comprises at least three distinct functional subcomponents, at least one of which is large and at least one of which is small, and further, all small subcomponents are loosely tethered together, and are mutually tethered to the at least one large subcomponent to form a single item for handling purposes;

wherein large means of a size, shape. and constitution to be reliably held in a rack designed to hold household food serving items; and loose tethering means allowing an effective freedom of movement to avoid areas prone to trap liquid.

25. The child-proof non-spill child's drinking cup of claim 24 wherein large subcomponents are further limited to subcomponents unable to fit through a rectangular opening of about 90 mm by about 38 mm and small subcomponents are further limited to subcomponents that are able to fit through a rectangular opening of about 65 mm by about 25 mm.

* * * * *